US006168129B1

(12) United States Patent
Krinner

(10) Patent No.: US 6,168,129 B1
(45) Date of Patent: Jan. 2, 2001

(54) DEVICE FOR VERTICAL ARRANGEMENT OF A POLE OR POST-LIKE OBJECT

(76) Inventor: Klaus Krinner, Blumenthal 19, D-94342, Strasskirchen (DE)

( * ) Notice: Under 35 U.S.C. 154(b), the term of this patent shall be extended for 0 days.

(21) Appl. No.: 09/492,153

(22) Filed: Jan. 27, 2000

Related U.S. Application Data

(63) Continuation of application No. PCT/DE97/01585, filed on Jul. 28, 1997.

(51) Int. Cl.[7] ..... E02D 5/80; F16M 13/00

(52) U.S. Cl. ..... 248/523; 248/530; 52/165; 52/166

(58) Field of Search ..... 248/121, 218.4, 248/511, 519, 535, 523, 530; 52/118, 135, 159, 165, 166, 302.5, 301, 365, 376; 403/283, 289, 403

(56) References Cited

U.S. PATENT DOCUMENTS

| | | | | |
|---|---|---|---|---|
| 646,364 | * | 3/1900 | Donnelly | 248/523 |
| 766,100 | * | 7/1904 | Carson | 52/159 |
| 930,607 | * | 8/1909 | Morrill | 52/165 |
| 1,291,823 | * | 1/1919 | Fuller | 248/519 |
| 1,679,297 | * | 7/1928 | Ehrler | 52/168 |
| 2,598,643 | * | 5/1952 | Kaplan et al. | 248/121 |
| 2,625,815 | * | 1/1953 | Black | 52/166 |
| 2,786,641 | * | 3/1957 | Applegate | 248/523 |
| 3,033,505 | * | 5/1962 | Brown | 47/40.5 |
| 3,135,364 | * | 6/1964 | Luttrell, Jr. | 52/165 |
| 3,324,613 | * | 6/1967 | Duboff | 52/126.7 |
| 3,596,862 | * | 8/1971 | Block | 248/121 |
| 4,585,201 | * | 4/1986 | Pursell | 248/523 |
| 5,350,149 | * | 9/1994 | Evans, Jr. et al. | 248/523 |
| 5,758,857 | * | 6/1998 | Gray | 52/165 |
| 5,957,424 | * | 9/1999 | Krinner | 248/530 |
| 6,050,034 | * | 4/2000 | Krinner | 52/165 |

FOREIGN PATENT DOCUMENTS

| | | |
|---|---|---|
| 296 06 034 U | 7/1996 | (DE) . |
| 97/08409 | 3/1997 | (WO) . |

* cited by examiner

*Primary Examiner*—Ramon O. Ramirez
*Assistant Examiner*—Jon Szumny
(74) *Attorney, Agent, or Firm*—Pillsbury Madison & Sutro LLP

(57) ABSTRACT

Disclosed is a device for the vertical arrangement of a pole or post-like object (4) on a fixing device (6) located in the ground, comprising a substantially cylindrical, longitudinally extended holding drift (10) which protrudes upwards from the free upper side of the fixing device (6) and which can be inserted into a receiving bore hole (12) on the lower front face (14) of the pole or post-like object (4). Also provided is a support plate (16) which is separate from the fixing device (6) and can be fixed onto the lower front face (14) of the pole or post-like object (4). At least one fixing attachment (18) protrudes upwards therefrom. In the middle of the support plate (16) there is an orifice (24) which is at least partially adapted to the cross-section of the holding drift (10). The support plate (16) also has a clamping section (26) which borders on the central orifice (24) and which is oriented in the same direction as the at least one attachment (18). Preferably, said clamping element is configured as a cylindrical sleeve (28) with at least one slot arranged in its circumference in an axial direction. Said sleeve is radially expanded when mounted on the holding drift (10).

20 Claims, 2 Drawing Sheets

DEVICE FOR VERTICAL ARRANGEMENT OF A POLE OR POST-LIKE OBJECT

This appln is a con't of PCT/DE97/01585 filed Jul. 28, 1997.

The invention relates to a device for the vertical arrangement of a pole or post-like object on a fixing device located in the ground, according to the preamble of claim 1.

When erecting poles or posts, for instance when erecting a fence, when putting up a road sign or the like, the problem always arising is to adjust the pole or post in the exactly vertical position, if possible. The vertical adjustment of a pole or post may be effected, for instance, by checking and possibly correcting the vertical arrangement by means of a water level or a plumb line when a pole or post is fixed or anchored in the ground by driving it in or embedding it in concrete. This is troublesome and time-consuming since, when for instance driving a pole or post into the ground, the driving operation has to be repeatedly interrupted in order to check and possible correct the arrangement of the pole or post. When embedding a pole or post in concrete, the exactly vertical arrangement of the same can indeed be corrected without difficulties before the concrete has set; then, however, means have to be applied to maintain this exactly vertical position until the concrete has set to such an extend that this vertical position can no longer be changed by itself. This means that the pole or post for instance has to be laterally supported or braced.

Apart from driving or digging a pole or post in or else embedding it in concrete, it is known to use fixing devices which can be anchored in the ground and which then support the pole or post-like object on their free upper end. The fixing device adapted to be anchored in the ground comprises, for example, a worm or screw which is drilled into the ground like a corkscrew, whereupon the pole or post is screwed to this fixing device or is inserted into the same. It is further known to integrally form the pole or post-like object and the fixing device adapted to be anchored in the ground like a corkscrew, so that the pole or post-like object includes at one of its free ends the fixing device which is then screwed into the ground and anchored therein. Also with this method or these possibilities of erecting a pole or post substantially the same problems arise regarding the vertical arrangement of the pole or post as when driving the latter in or embedding it in concrete. Instead of the driving operation, the screwing of the fixing device into the ground must be repeatedly interrupted in order to safeguard the later vertical position of the pole or post by appropriate measuring and possibly by correcting steps.

DESCRIPTION OF RELATED ART

DE-GM 93 13 260 suggest an adjusting device between a fixing device adapted to be anchored in the ground, for instance a ground screw, and the pole or post-like object to be fixed thereto. In accordance with an embodiment of DE-GM 93 13 260, this adjusting device substantially comprises a cylindrical longitudinally extended holding drift protruding upwards from the free upper side of the fixing device and being adapted to be inserted into a receiving bore hole in the underside of the pole or post-like object. The axial extension of the holding drift and the depth of the receiving bore hole are selected such that the former is somewhat longer than is the depth of the latter, so that, when slipping the pole or post-like object on the holding drift, the free end of it rests on the bottom of the receiving bore hole. The pole or post-like object is now adjusted in an exact vertical position—possibly with the aid of a plumb line or a water level—whereupon one or several strokes are applied to the upper end of the object, so that the free end of the holding drift penetrates the bottom of the blind bore and thus the object is fixed in its exactly vertical position vis-á-vis the fixing device.

The subject matter of DE-GM 93 13 260 has extensively proved successful in practice; nevertheless, it still has the minor drawback that due to the close positive-locking surrounding of the journal by the material of the pole or post the post shoe itself must be anchored exactly vertically in the ground so as to ensure a vertical position of the pole or post held hereby. DE-GM 93 13 260 in a further embodiment indeed suggests adjusting devices between the post and the fixing device in order to position the post exactly vertically even in the case of a fixing device located in the ground in an oblique or inclined way, but these adjusting devices are quite expensive.

DE-GM 89 03 236 disclosed a device in the form of a post shoe for wooden designs and especially for wooden designs of playground climbing frames. This known device comprises a fixing device located in the ground in the from of an anchoring member to be anchored in the ground or in a foundation, and a support member arranged hereon and adapted to be positively connected with the pole or post. The support member is a vertically extending journal which is held in a recess in the underside of the post such that the post closely fits around the journal, i.e. in a practically positive-locking manner. Furthermore, a resting surface or support plate for the post is provided, from the plane of which the journal protrudes upwards and on which the underside of the post rests. The support plate further has a circumferential toothed ring which digs into the front face by strokes being applied on the upper end of the post and provides a fixing of the position in transverse direction. As an additional protection from removal or detachment, a transversely extending pin is provided which passes horizontally both through the material of the post and through the material of the journal. By the post shoe according to DE-GM 89 03 236 the post or pole is supported at a particular distance above the ground, so that it is better protected from weather influences due to rain, snow or the like, and from vermin and weed.

Although by the post shoe according to DE-GM 89 03 236 the object given there can indeed be achieved and no problems have to be expected on the whole as regards a loosening of the fixing device since the post—with the exception of the stokes applied on the upper end—is slipped onto the journal substantially without force, this post shoe or this fixing device again has the essential drawback that due to the close positive-locking surrounding of the journal by the material of the pole or post the post shoe itself must be anchored exactly vertically in the ground so as to ensure a vertical position of the pole or post held hereby. As for the rest, also the post shoe according to DE-GM 89 03 236 may cause problems with respect to a loosening of the fixing device located in the ground when the material of the post or pole is especially hard, so that a certain expenditure of energy is necessary to force the toothed ring into the front face of the post or pole. In this cased, the stroke or the strokes with which the pole or post-like object is fixed to the fixing device has/have to be fairly strong to achieve the holding forces necessary for the object. In the unfavorable case it is therefore possible that the fixing device—especially in loose soil or sand—tends to loosen due to these strokes, so that, with higher forces exerted on the object, there is the risk that the object will lose its vertical position or even fall over. A device for the vertical arrangement of a pole or post-like object on a fixing device located in the ground according to the preamble of claim 1 has become known from PCT/EP96/03704. This generic device essentially consists of a substantially cylindrical, longitudinally extended holding drift which protrudes upwards from the free upper side of the fixing device and which can be inserted into a receiving bore hole in the underside of the pole or post-like object; and a support plate which is separate from the fixing device and can be fixed onto the lower front face of the pole or post-like object, from which at least one fixing attachment protrudes upwards which forces itself into the material of the pole or post-like object, the support plate comprising a central orifice which is at least partially adapted to the cross-section of the holding drift, the holding drift being substantially thinner than the receiving bore hole in the underside of the pole or post-like object.

This provides a possibility for the vertical positioning or adjustment since the holding drift is substantially thinner than the receiving bore hole in the underside of the pole or post-like object. In other words, in contrast to the teaching of DE-GM 89 03 236 in which the material of the pole or post surrounds the drift or journal in a positive-locking manner, in the case of the subject matter of PCT/EP96/03704 there is considerable play between the journal or holding drift and the bore surrounding the drift in the underside of the pole or post. Due to this play it is possible to mount the pole or post on the holding drift such that the pole or post is tilted or inclined within a given angular range, this inclined or tilted position permitting compensation of any positions of the fixing device located in the ground which are lopsided relative to the vertical.

The generic fixing device according to PCT/DE96/03704 also has extensively proved successful in practice. All the same, it has turned out in practice that the holding forces, the sole positive-locking and/or frictional connection between the holding drift and the material of the pole may not always be sufficient under particular circumstances.

BRIEF SUMMARY OF THE INVENTION

Compared to this, it is the object of the present invention to provide a device for the vertical arrangement of a pole or post-like object on a fixing device located in the ground, in which the connection between the actual fixing device and the pole or post-like object is so stable that even major forces exerted on the pole or post-like object can reliably be absorbed, without the connection between the fixing device and the object being loosened or released.

According to the invention, the fixing device known form PCT/EP96/03704 is further developed in that a clamping section which is oriented in the same direction as the at least one fixing attachment and which surrounds the central orifice is positioned at the support plate, the outer circumference of said clamping section being adapted to at least partially take its bearing on the inner circumferential wall of the receiving bore hole; that the holding drift has, adjacent to the free upper face of the fixing device, an outer diameter which slightly exceeds the inner diameter of the clamping section; and that the clamping section is configured as a cylindrical sleeve which is radially expandable outwardly by the holding drift when being mounted thereon.

The clamping section inform of the sleeve very considerably enlarges the contact face between the holding drift and the support plate vis-á-vis a support plate not comprising a clamping section, so that far higher holding forces can be achieved which safely hold the pole or post-like object even when major forces are exerted thereupon. Since, furthermore, the outer circumference of the clamping section is adapted to at least partially take its bearing on the circumferential wall of the receiving bore hole, an improved absorbance and introduction of forces from the pole or post-like object via the support plate to the fixing device ensues.

Advantageous further developments of the invention are the subject matter of the subclaims.

Preferably, the holding drift and the orifice both are of round cross-section. This renders it possible that the post may deliberately be turned vis-á-vis the holding drift and thus the fixing device, so that for instance possible construction elements fixed to the post and radially extending therefrom may be positioned as desired.

In another preferred embodiment, the holding drift conically tapers starting from the free upper face of the fixing device towards its free end. This renders it possible that a particularly strong circumferential positive-locking and/or frictional connection ensues between the holding drift and the clamping section.

Furthermore, if the clamping section is configured as a sleeve with at least one slot arranged in its circumference in an axial direction, a radial expansion of the sleeve ensues in the course of the penetration of the holding drift which is conically widening towards its bottom, so that the sleeve may take its bearing on the inner circumferential wall of the receiving bore hole at force or pressure, respectively.

In a particularly preferred embodiment, the sleeve is in its axial direction provided with a plurality of equidistant slots in such a way that a plurality of tongues projecting from the support plate and surrounding the central orifice is formed. In the course of the inserting the holding drift, these tongues consistently are radially expanded or pressed outwardly, so that a close and loadable connection between the pole or post-like object, the support plate and the holding drift or the fixing device, respectively, will ensue.

In another preferred embodiment, a plurality of fixing attachment projects upwards from the support plate. This provides better connection between the support plate and the pole or post-like object.

In another preferred embodiment, the fixing attachments are configured in the form of conically tapering tips, so that it is easy for them to dig into the material of the object.

When the fixing attachments are distributed regularly on at least one circle concentric to the orifice, forces accruing especially by the radially expanding sleeve and acting in the object towards the outside, are absorbed by the fixing attachments, so that the risk of tearing or splintering of the lower end portion of the object is substantially reduced.

Further details, aspects and advantages of the present invention result from the following description of several embodiments by means of the drawing.

DETAILED DESCRIPTION OF THE DRAWING

The following description of a preferred embodiment of the present invention has to be considered as purely illustrating and exemplary; the representation in the figures and the pertaining description shall not be understood to be restricting.

Figure 1:
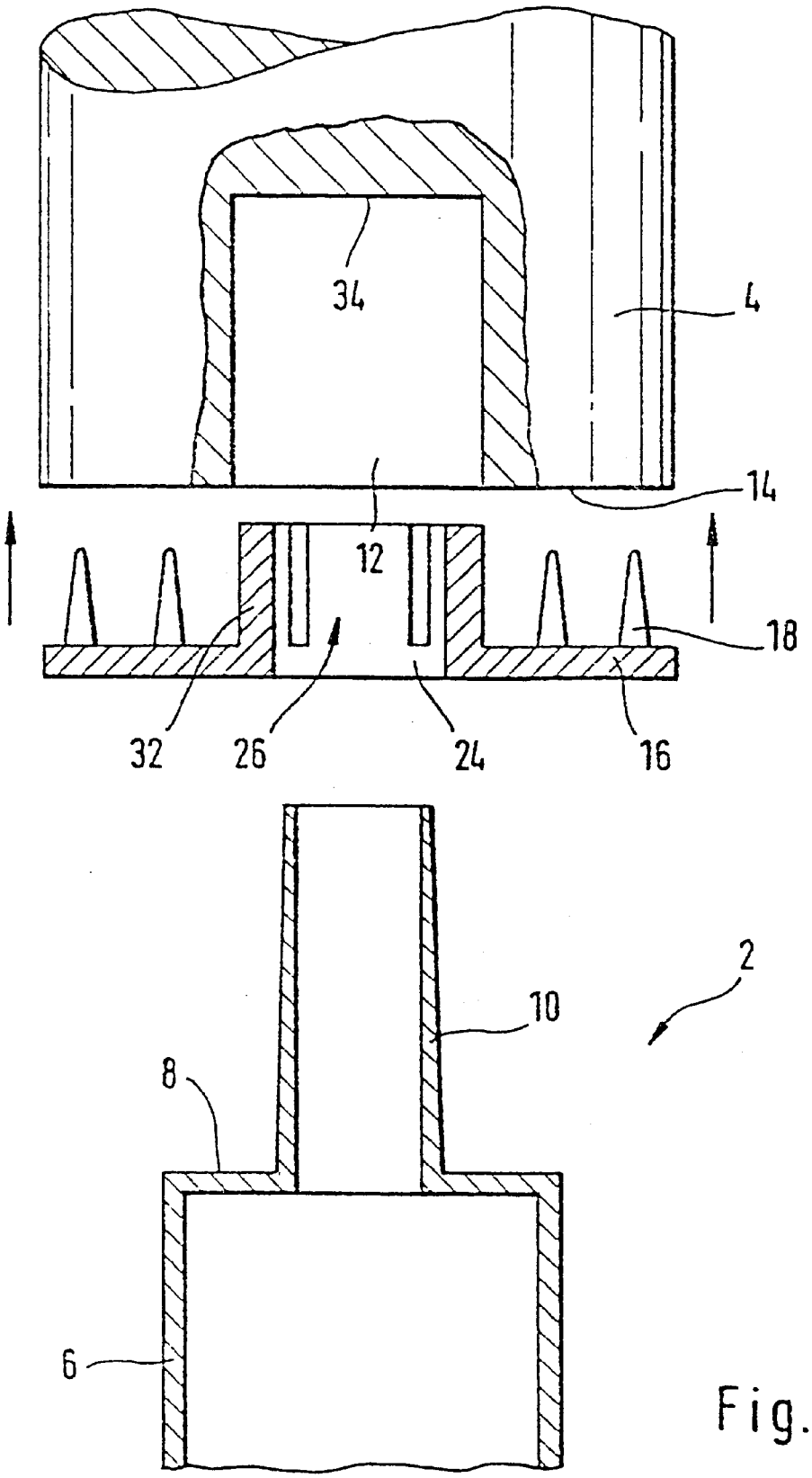
FIG. 1 is a disassembled view of an embodiment of the present invention in the dismounted state.

FIG. 1 shows an embodiment of the present invention for the vertical arrangement of a pole or post-like object (in the following referred to as "post") on a fixing device located in the ground.

FIG. 1 illustrates an embodiment of a device 2 in accordance with the invention, which serves the vertical arrangement of a post 4 on a fixing device 6 which can for instance be anchored in the ground. The fixing device 6 may for instance be dug in or embedded in concrete or, preferably, be screwed into the ground like a corkscrew. A particularly preferred embodiment of the fixing device 6 is described in DE-GM 93 13 258 of the same Applicant. Reference is herewith made to the entire contents of disclosure of this document.

In the embodiment of the device 2 illustrated in FIG. 1 this device comprises a receding portion or step 8 at the free upper end of the fixing device 6, which comprises a tubular holding drift 10 in the middle thereof. The outer diameter of the holding drift 10 is distinctly smaller than the inner diameter of a receiving or blind bore hole 12 configured at the free lower end of the post 4. The depth of the bore hole 12 preferably is smaller than the height of the holding drift 10.

Figure 2:
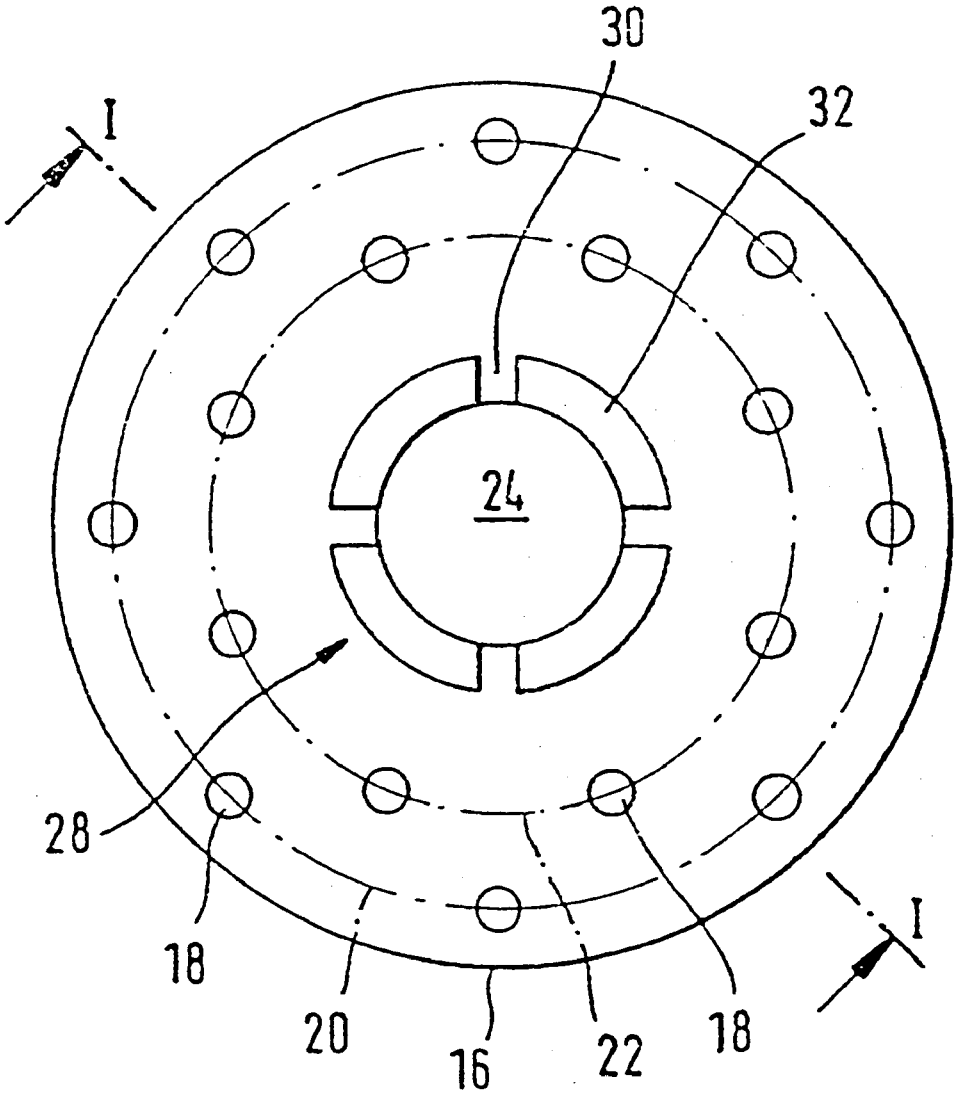
FIG. 2 is a top view of an embodiment of a support plate.

Between the step 8 and front face 14 of the post 4 where the bore hole 12 is applied, support plate 16 may be positioned. The form and face of the support plate preferably is adapted to the form and face of the front face 14, i.e. as a rule is circular, as is shown in FIG. 2. From the upper side of the support plate 16, at least one, preferably a plurality of fixing attachments 18 protrude upwards in the direction of the front face 14. In accordance with the drawing, a plurality of tooth, prong or spike-shaped fixing attachments 18 may extend upwards from the support plate 16, these fixing attachments, in accordance with FIG. 2, preferably being positioned equidistantly to each other on one or a plurality of concentric circles 20 and 22.

The support plate 16 comprises a central orifice 24 which is configured in the support plate 16 such that it is substantially in alignment with the bore hole 12 in the lower end portion of the post 4 after the support plate 16 has been positioned at the front face 14.

As may best be seen from FIG. 2, the central orifice 24 is surrounded by a clamping section 26 in the support plate 16. The clamping section 26 essentially has, in accordance with the representation in the drawing, the shape of a sleeve 28 with at least one, preferably, however, a plurality of slots 30 arranged in axial direction, so that the sleeve 28, depending on the number of slots 30, is divided into a plurality of tongues 32. In the embodiment shown, four slots 30 are provided which are positioned on the circumference at a regular distance of each other of 90°, so that four tongues are formed. The inner diameter of the sleeve 28 essentially corresponds to the inner diameter of the orifice 24.

The post 4 is fixed to the device 2 in such a way that first of all the fixing device 6 is anchored in the ground, for instance by screwing in or embedding in concrete.

Subsequently, the support plate 16 is mounted on the lower or front face 14 of the post 4 and is connected with the front face 14. To this end, fixing attachments 18 are provided at the support plate 16 which dig in to the material of the post 4 when one or a plurality of hammer strokes is applied on the support plate 16.

After mounting the support plate 16, the post is, in accordance with FIG. 1, mounted on the fixing device 6 from the top. Then, the post 4 is—preferably with the aid of a plumb line or a water level—tilted such that possible positions of the fixing device 6 lopsided relative to the vertical are compensated and the post 4 is in an exact vertical position. This tilting of the post 4 relative to the fixing device 6 is enabled by the fact that the outer diameter of the holding drift 10 is distinctly smaller than the inner diameter of the bore hole 12, so that the holding drift 10 may extend obliquely or inclinedly inside the bore hole 12. As soon as the post 4 is standing exactly vertically, one or a plurality of strokes is applied on the upper free end of the post 4 with a hammer or some other suitable driving instrument, so that the holding drift 10 which is conically widening towards its bottom penetrates the sleeve 28 and expands it radially outwardly. This expansion is facilitated by the slots 30 which are dividing the sleeve 28 at least once, preferably, however, a plurality of times in axial direction, so that the sleeve 28 may be considered to be divided into a plurality of resilient holding tongues. In the course of the radial expansion of the sleeve 28, it is pressed with pressure against the inner circumferential wall of the receiving bore hole 12 and is braced towards it. Simultaneously, the upper free end of the holding drift 10 digs into a basic face 34 of the receiving bore hole 12, so that the post 4 is safely fixed in two positions, namely in the area of the sleeve 28 on the one hand and in the area of the basic face 34 of the receiving bore hole 12 on the other hand. Thus, the post 4 is held vis-á-vis the fixing device 6.

The fixing in position of the post vis-á-vis the fixing device 6 may be considered to be practically immovable due to the high clamping forces existing between the sleeve 28 and the post 4 generated by the radial expansion of the sleeve 28. This positive-locking and/or frictional connection of the sleeve 28 with the holding drift 10 or the support plate 16, respectively, may be increased by that the holding drift 10 also penetrates the orifice 24 with positive-locking and/or frictional connection when the maximum effective outer diameter of the holding drift 10 is made somewhat larger than the inner diameter of the orifice 24.

Due to the blade-like beveling of the upper circumferential edge of the holding drift 10 caused by its conical shape, this area may easily die into the material of the post 4. Expanding or tearing forces that might be exerted on the material of the post 4 by the holding drift 10 and the sleeve 28 area absorbed by one or a plurality of rings of the fixing attachments 18, so that the entire lower area of the post 4—with the exception of the penetrated fixing attachments (s) 18—remains safe and sound and thus less susceptible to weather influences, vermin and weed or the like.

The cross-section of the orifice 24 substantially depends on the cross-section of the holding drift 10. This means that, if the holding drift 10 is tubular with circular cross-section, the orifice 24 also preferably is of round cross-section, as is shown in FIG. 2. The orifice 24 may, however, as well be of square of polygonous cross-section.

A polygonous, i.e. multi-angular cross-section of the orifice 24 may also be used with a round cross-section of the holding drift 10.

Since the support plate 16 is fixed onto the front face 14 of the post 4 prior to the mounting of the post 4 on the holding drift 10 of the fixing device 6, the forces necessary for fixing the post 4 onto the fixing device 6 are restricted to those forces that are necessary for mounting the post 4 on the holding drift 10, this penetrating the orifice 24 preferably manufactured at a dimension smaller than specified, and the forces necessary for forcing or slamming the drift 10 into the basic face 26 and for expanding the sleeve 28. The risk that the fixing device 6 may get loose by forces exerted on the post 4 during its fixing in the ground thus is substantially reduced. Furthermore, due to the sleeve 28 expanding radially and taking its bearing on the inner circumference of the receiving bore hole 12 at high pressure, very high and in particular lasting holding forces may be achieved, so that the post 4 can reliably be fixed in position.

What is claimed is:

1. A device for the vertical arrangement of a pole or post-like object, comprising:

a fixing device adapted to be located in the ground;

a substantially cylindrical, longitudinally extended holding drift which protrudes upwards from the free upper side of the fixing device and which is adapted to be inserted into a receiving bore hole on the lower front face of the pole or post-like object;

a support plate which is separate from the fixing device and adapted to be fixed onto the lower front face of the pole or post-like object, from which at least one fixing attachment protrudes upwards, said at least one fixing attachment adapted to force itself into the material of the pole or post-like object, said support plate comprising a central office which is at least partially adapted to the cross-section of the holding drift, with the holding drift is adapted to be substantially thinner than the receiving bore hole in the pole or post-like object, and a clamping section which is oriented in the same direction as said at least one fixing attachment and which surrounds said central orifice is positioned on said support plate, the outer circumference of said clamping section being adapted to at least partially take its bearing on an inner circumferential wall of said receiving bore hole; wherein said holding drift has, adjacent to the free upper face of said fixing device, an outer diameter which slightly exceeds an inner diameter of said clamping section; and said clamping section is configured as a cylindrical sleeve which is radially expandable outwardly by said holding drift when mounted thereupon.

2. The device according to claim 1, wherein said holding drift and said orifice both are of round cross-section.

3. The device according to claim 1 or 2, wherein said holding drift slightly tapers conically starting from the free upper face of said fixing device towards its free end.

4. The device according to claim 3, wherein said sleeve has at least one slot arranged in an axial direction.

5. The device according to claim 3, wherein said sleeve is in its axial direction provided with a plurality of equidistant slots in such a way that a plurality of tongues projecting from said support plate and surrounding said central orifice are formed.

6. The device according to claim 3, including a plurality of fixing attachments protruding upwards from said support plate.

7. The device according to claim 6, wherein said fixing attachments are configured in the form of conically tapering tips.

8. The device according to claim 7, wherein said fixing attachments are regularly distributed on at least one circle concentric to said orifice.

9. The device according to claim 1 or 2, wherein said sleeve has at least one slot arranged in an axial direction.

10. The device according to claim 9, wherein said sleeve is in its axial direction provided with a plurality of equidistant slots in such a way that a plurality of tongues projecting from said support plate and surrounding said central orifice are formed.

11. The device according to claim 10, including a plurality of fixing attachments protruding upwards from said support plate.

12. The device according to claim 11, wherein said fixing attachments are configured in the form of conically tapering tips.

13. The device according to claim 12, wherein said fixing attachments are regularly distributed on at least one circle concentric to said orifice.

14. The device according to claim 9, including a plurality of fixing attachments protruding upwards from said support plate.

15. The device according to claim 14, wherein said fixing attachments are configured in the form of conically tapering tips.

16. The device according to claim 15, wherein said fixing attachments are regularly distributed on at least one circle concentric to said orifice.

17. The device according to claim 1 or 2, including a plurality of fixing attachments protruding upwards from said support plate.

18. The device according to claim 17, wherein said fixing attachments are configured in the form of conically tapering tips.

19. The device according to claim 18, wherein said fixing attachments are regularly distributed on at least one circle concentric to said orifice.

20. The device according to claim 17, wherein said fixing attachments are regularly distributed on at least one circle concentric to said orifice.

* * * * *